US008025419B2

(12) United States Patent
Yang

(10) Patent No.: US 8,025,419 B2
(45) Date of Patent: Sep. 27, 2011

(54) WEATHER RESISTANT ROAD LIGHT

(76) Inventor: Kevin Yang, Palos Verdes Estates, CA (US)

( * ) Notice: Subject to any disclaimer, the term of this patent is extended or adjusted under 35 U.S.C. 154(b) by 370 days.

(21) Appl. No.: 12/386,431

(22) Filed: Apr. 17, 2009

(65) Prior Publication Data

US 2010/0265724 A1 Oct. 21, 2010

(51) Int. Cl.
*F21S 8/00* (2006.01)

(52) U.S. Cl. ..... 362/153.1; 362/222; 362/223; 362/217.15; 362/217.16; 362/217.12; 362/217.11

(58) Field of Classification Search ..... 362/153.1, 362/221, 222, 223, 217.1, 217.14, 217.15, 362/217.16, 217.11, 217.12, 267; 220/326, 220/4.22, 845

See application file for complete search history.

(56) References Cited

U.S. PATENT DOCUMENTS 3,055,535 A * 9/1962 Schneider ..... 220/326
3,065,338 A * 11/1962 Izzi et al. ..... 362/306
3,283,139 A * 11/1966 Harling ..... 362/306
6,394,628 B1 * 5/2002 Wang ..... 362/375

* cited by examiner

*Primary Examiner* — Sharon Payne
(74) *Attorney, Agent, or Firm* — Clement Cheng

(57) ABSTRACT

A weather resistant road light comprises a top cover and a ballast mounting surface disposed on a top surface of the top cover. The ballast mounting surface defines a ballast compartment lower surface. At least one wire aperture seat is disposed on the ballast mounting surface. A ballast is mounted to the at least one wire aperture seat. Wires from the ballast pass through the wire aperture seat. A ballast compartment cover covers the ballast compartment. The ballast compartment cover fits over the top of the ballast mounting surface disposed on the top cover. At least one securing member secures the ballast to the ballast mounting surface. A bottom tray mates with the top cover, and the bottom tray has a lens opening. A reflector assembly has a socket for receiving a bulb. The reflector assembly is mounted on the bottom tray.

8 Claims, 10 Drawing Sheets

WEATHER RESISTANT ROAD LIGHT

BACKGROUND OF THE INVENTION

A. Field of the Invention

The present invention relates to weather resistant road lighting.

B. Description of the Prior Art

As seen in FIGS. 1-3, the prior art road light has a housing with a lens facing downward. The housing is typically made of a top cover, and a bottom tray. Components are sandwiched between the top cover and bottom tray. A ballast is typically mounted behind the lamp which is typically a high-intensity discharge lamp or LED lamp. The ballast is thus enclosed in the same space as the high-intensity discharge lamp. The high-intensity discharge lamp has a reflector enclosing the lamp between the reflector and the lens. The reflector optionally includes a seal for sealing the lens from the elements.

SUMMARY OF THE INVENTION

The present invention is an alternate construction for a road light. The present invention uses a double section top cover. The double section top cover has a ballast compartment formed on a top surface of the top cover. The double section top cover is covered by a ballast compartment cover which goes over the top surface of the top cover. The ballast communicates with the internal portion of the housing by a pair of apertures. Optionally, vent openings are formed on lateral surfaces of the ballast compartment cover. The under portion, or bottom surface of the ballast compartment can be reinforced by reinforcing ribs.

The objects, features, and advantages of the present invention are readily apparent from the following detailed description of the best mode for carrying out the invention when taken in connection with the accompanying drawings.

BRIEF DESCRIPTION OF THE DRAWINGS

Similar reference numbers denote corresponding features throughout the attached drawings.

Figure 1:
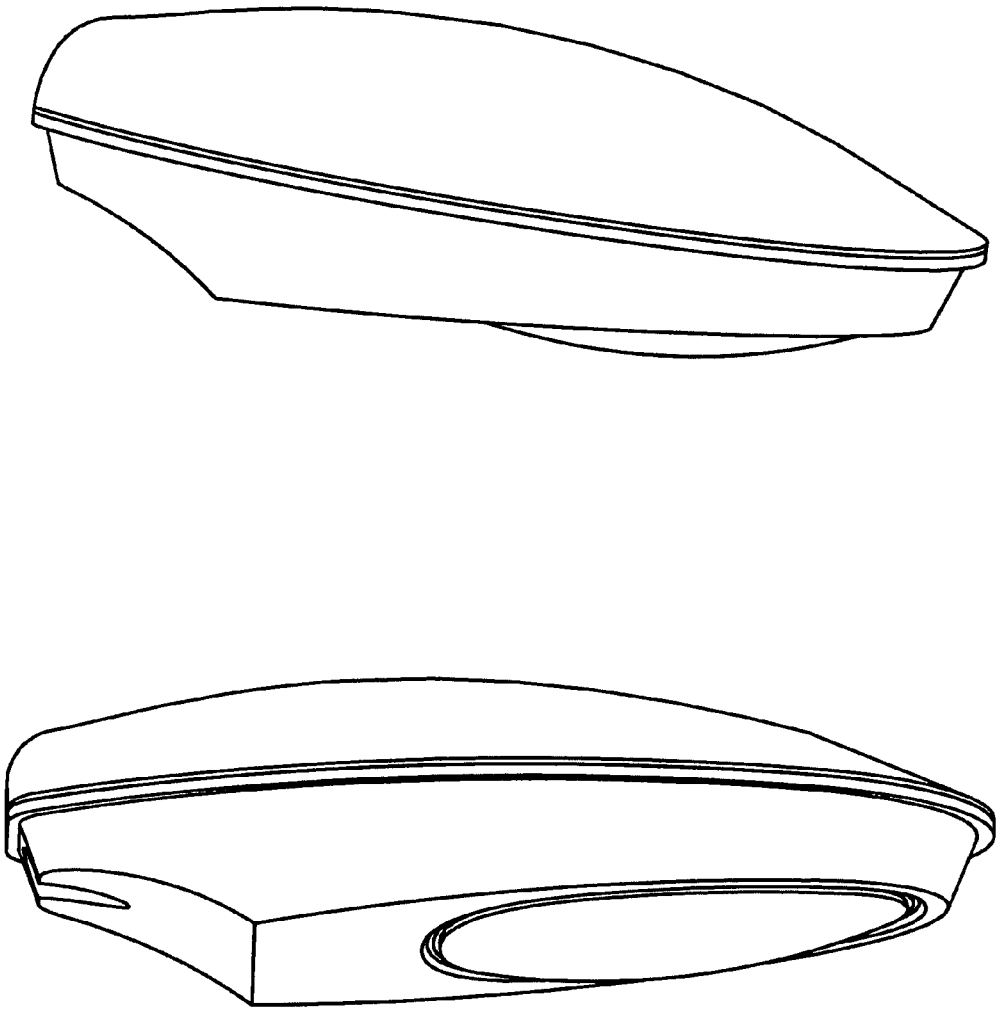
Fig. 1 (Prior Art)
FIG. 1 is a perspective view of an outside view of a prior art housing.
Figure 2:
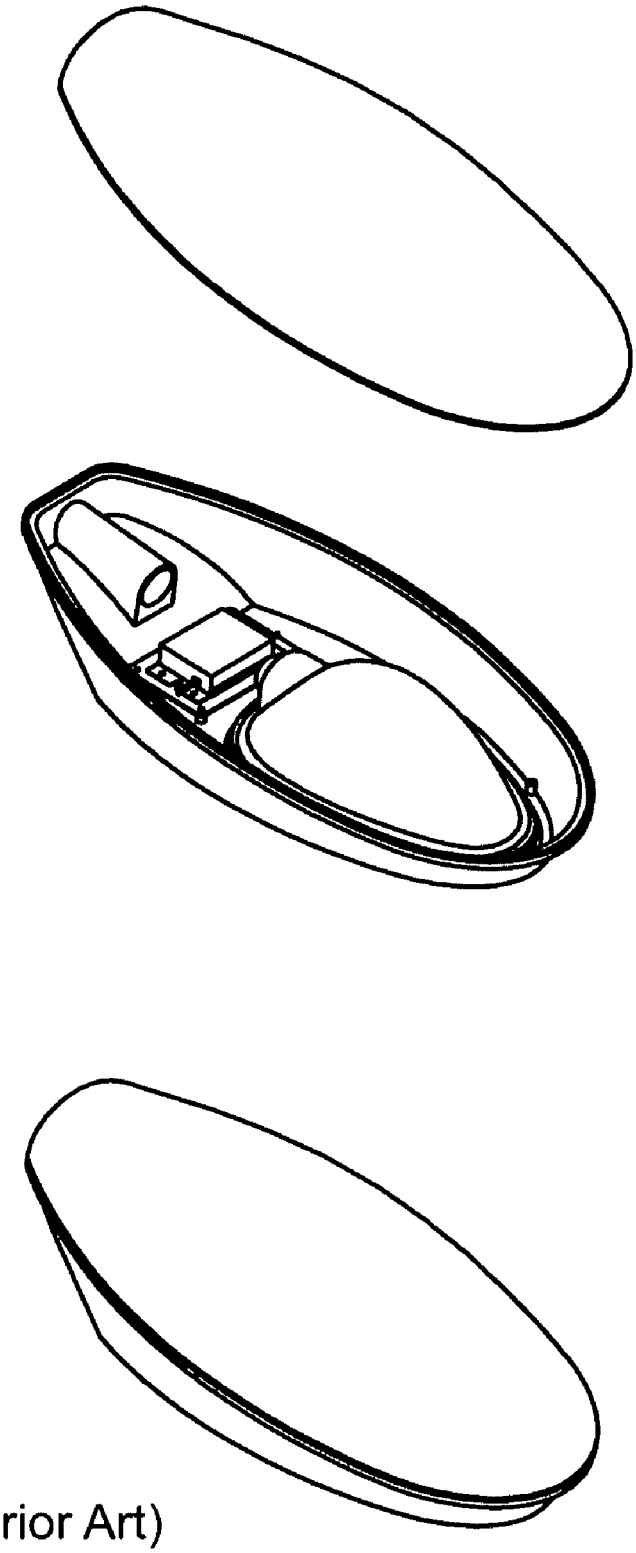
Fig. 2 (Prior Art)
FIG. 2 is a perspective exploded view of a prior art housing.
Figure 3:
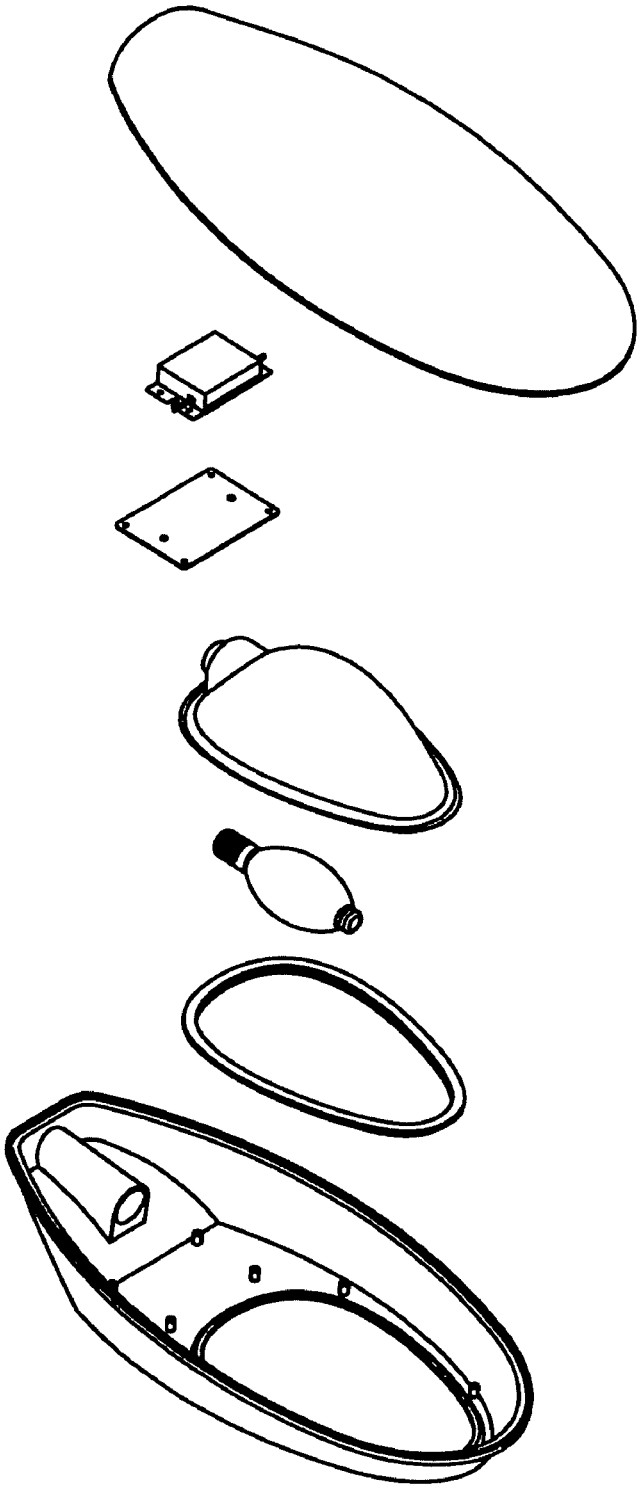
Fig. 3 (Prior Art)
FIG. 3 is a perspective exploded view of a prior art housing.

88 gap
110 bottom tray
120 top cover
121 reinforcement rib
122 mounting post
123 wire aperture seats, also called annular protrusions
125 ballast compartment cover
126 vent openings
130 reflector assembly
140 lens seal
144 lens
150 ballast
156 seal rings
158 ballast wire
159 ballast conduit
161 securing members
162 ballast mounting surface
180 bulb
190 post receiver

DETAILED DESCRIPTION OF THE PREFERRED EMBODIMENT

Figure 4:
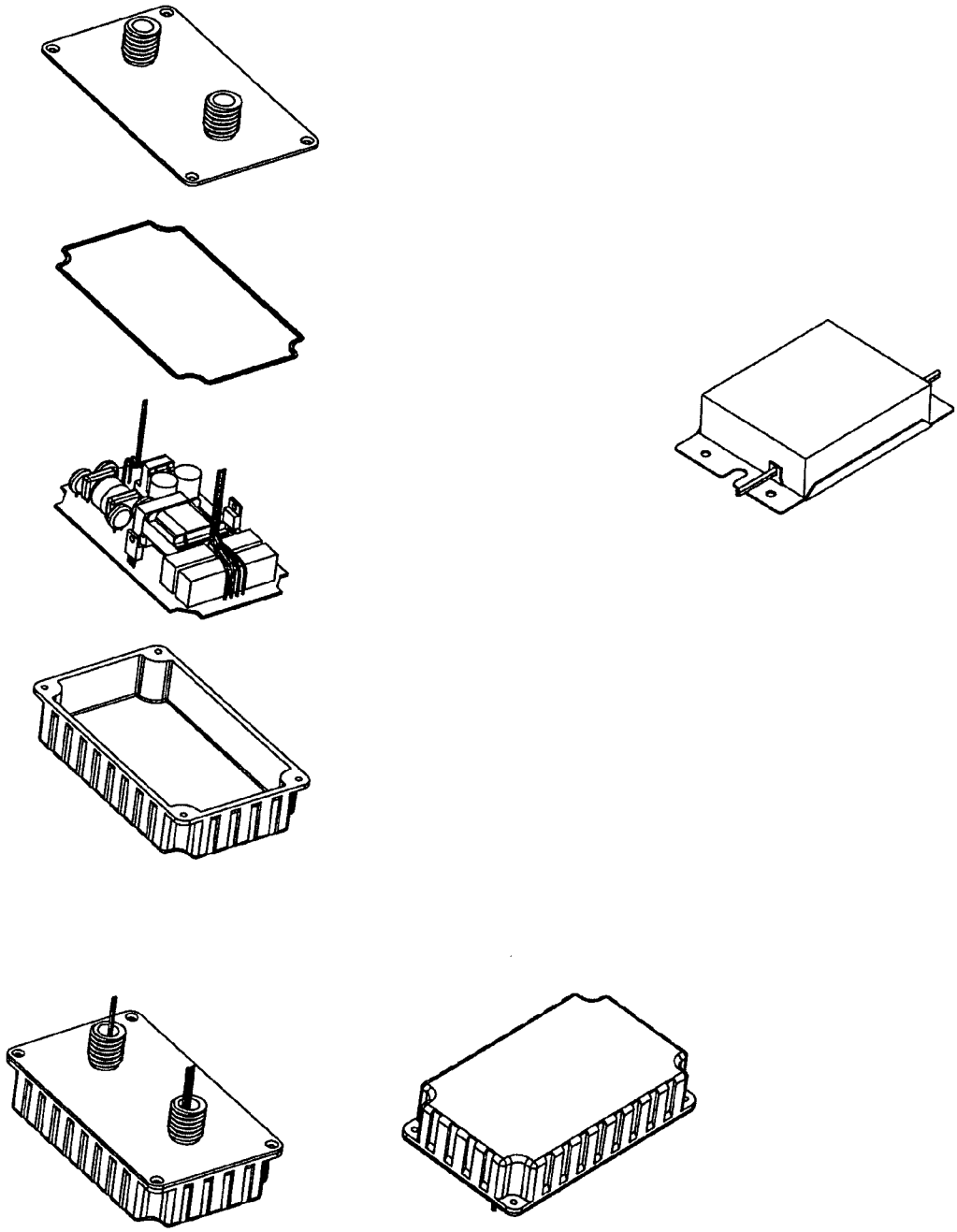
FIG. 4 is a perspective exploded view of a ballast of the present invention compared with a ballast of the prior art on the right.

FIG. 4 shows the improved ballast construction. The ballast has a ballast top cover made of a material such as aluminum that has heat fins molded on an outer surface. The ballast is shown upside down with the ballast top cover appearing as a tray having four openings for receiving a screw. Within the ballast is a number of electronic components mounted on a printed circuit board. The components are sealed using a seal such as the one shown between the electronic components and the ballast bottom cover. The ballast bottom cover has a pair of threaded conduits. The ballast bottom cover preferably has openings for screw connection of the ballast bottom cover to the ballast top cover. FIG. 4 shows the exploded view of the ballast in the upper left corner, the assembled view of the ballast in the lower right corner, and an upside down view of the a simple ballast in the lower left corner. The upper right corner is a prior art ballast for comparison. The prior art ballast is typically made of a folded metal case.

Figure 5:
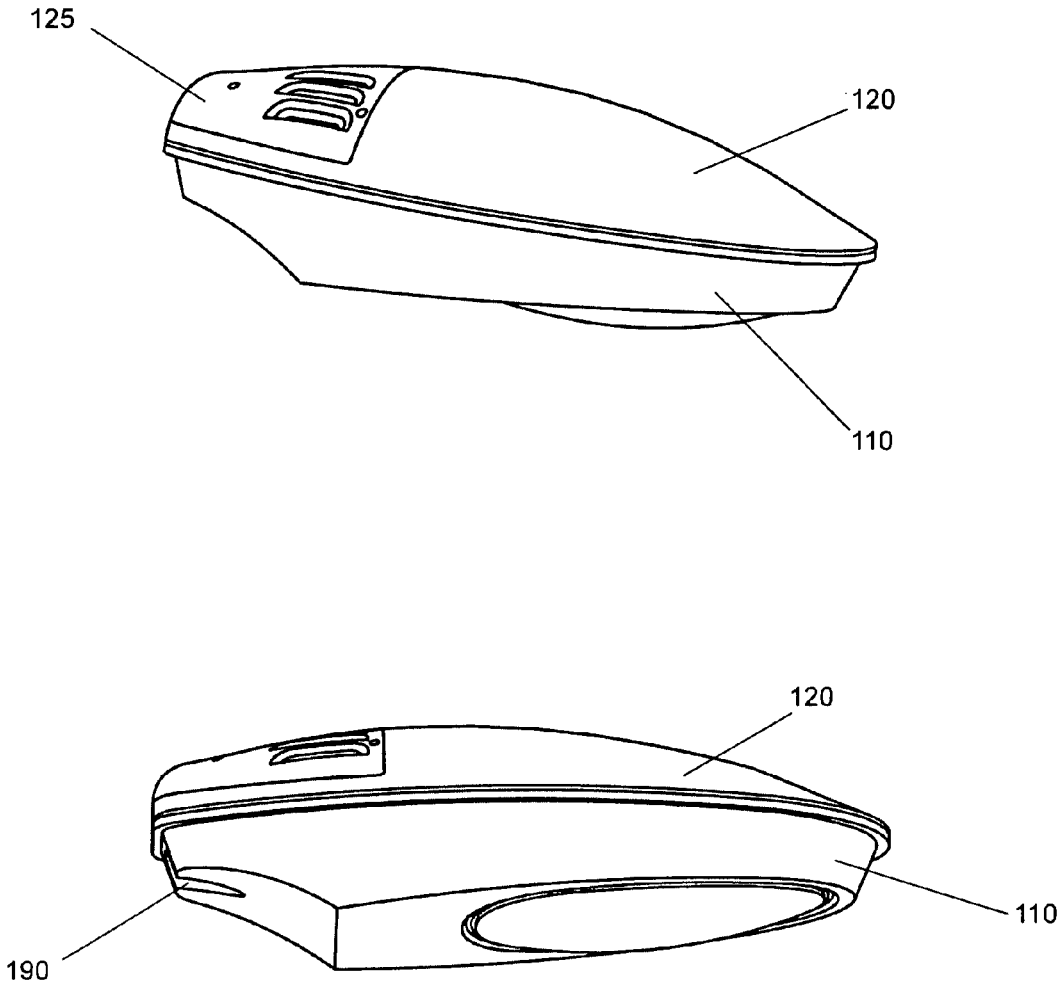
FIG. 5 is an assembled exterior view of the present invention.

FIG. 5 has a diagram at the upper portion of the page which shows a top portion of a road light with the top cover 120 fitting over the bottom tray 110. The top cover 120 has a ballast compartment cover 125 fitting over the top cover. FIG. 5 has a diagram at the lower portion of the page showing the lower portion of the road light. The lower view shows a top cover 120 fitting over a bottom tray 110. The lower view also shows a slot shaped post receiver 190 formed on the bottom tray 110 for receiving a post. The lamp can be mounted on a post which can be inserted horizontally into the housing, at the post receiver 190. The post is typically a tubular steel member.

Figure 6:
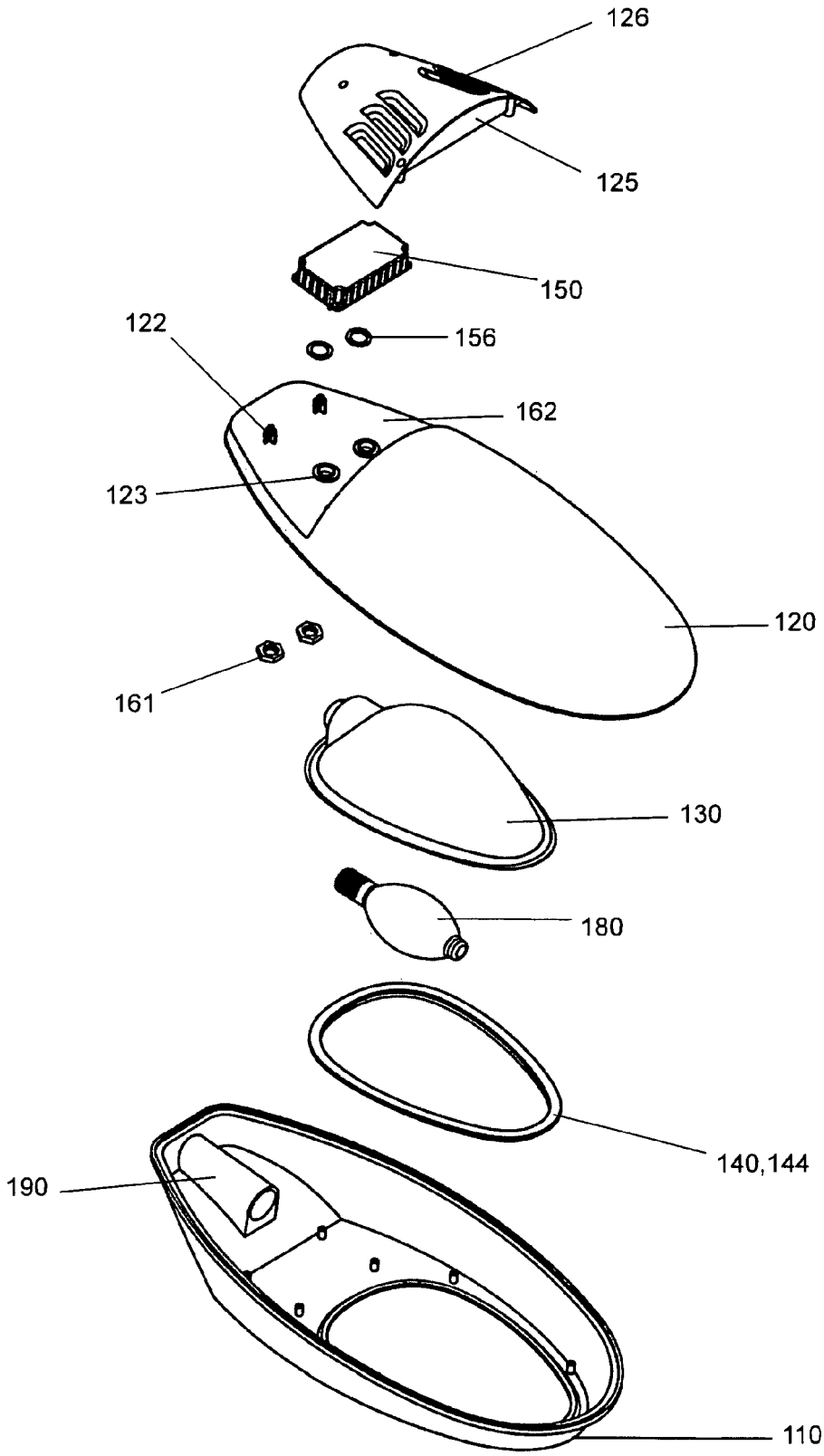
FIG. 6 is a top exploded view of the present invention.

FIG. 6 shows the internal view of the post receiver 190 molded on the bottom tray 110. The post receiver 190 has a cylindrical profile on the internal portion of the bottom tray 110, and forms a slot shaped profile on the external portion of the bottom tray 110. The lens 144 and the lens seal 140 fit onto an opening formed in the bottom of the bottom tray 110. A plurality of short protrusions retains the lens 144 and the lens seal 140 in position. A reflector 130 receives a bulb 180. The reflector is covered by the top cover 120. The top cover 120 mates with the lower bottom tray 110 at a top cover interface forming a plane that is above the post receiver, above the lens 144, above the lens seal 140, and above the short protrusions. The lens 144 and the lens seal 140 mate with the bottom tray 110 and an interface below the post receiver 190.

The top cover 120 has a flat ballast mounting surface 162 for receiving a ballast. The ballast 150 rests on a pair of annular protrusions 123 which each have a step for receiving an annular seal ring 156 and an external periphery of the annular protrusion 123. The annular protrusion 123 protrudes above the surface of the flat ballast mounting surface 162. The annular seal ring 156 is preferably made of an elastomeric material for water resistance. The annular seal ring preferably protrudes above the step formed on the annular protrusions 123. The step has a higher portion on an internal periphery, and has a lower portion on an external periphery. The annular seal ring 156 is preferably mounted on the lower portion on the external periphery. The nuts 161 are securing members 161 which connect the ballast 150 to the annular protrusion 123. The annular protrusions 123 are wire aperture seats 123 because the ballast is seated on the wire aperture seats 123.

One or more mounting posts 122 can be disposed on the ballast mounting surface 162 for screw connection between the ballast compartment cover and the ballast mounting surface 162. The ballast mounting surface 162 is formed on a top surface of the top cover 120. The ballast mounting surface 162 is preferably at least somewhat tilted for draining water, although it could also be horizontal. The ballast compartment cover 125 preferably has vent openings 126 which allow natural convection through the ballast compartment.

Figure 7:
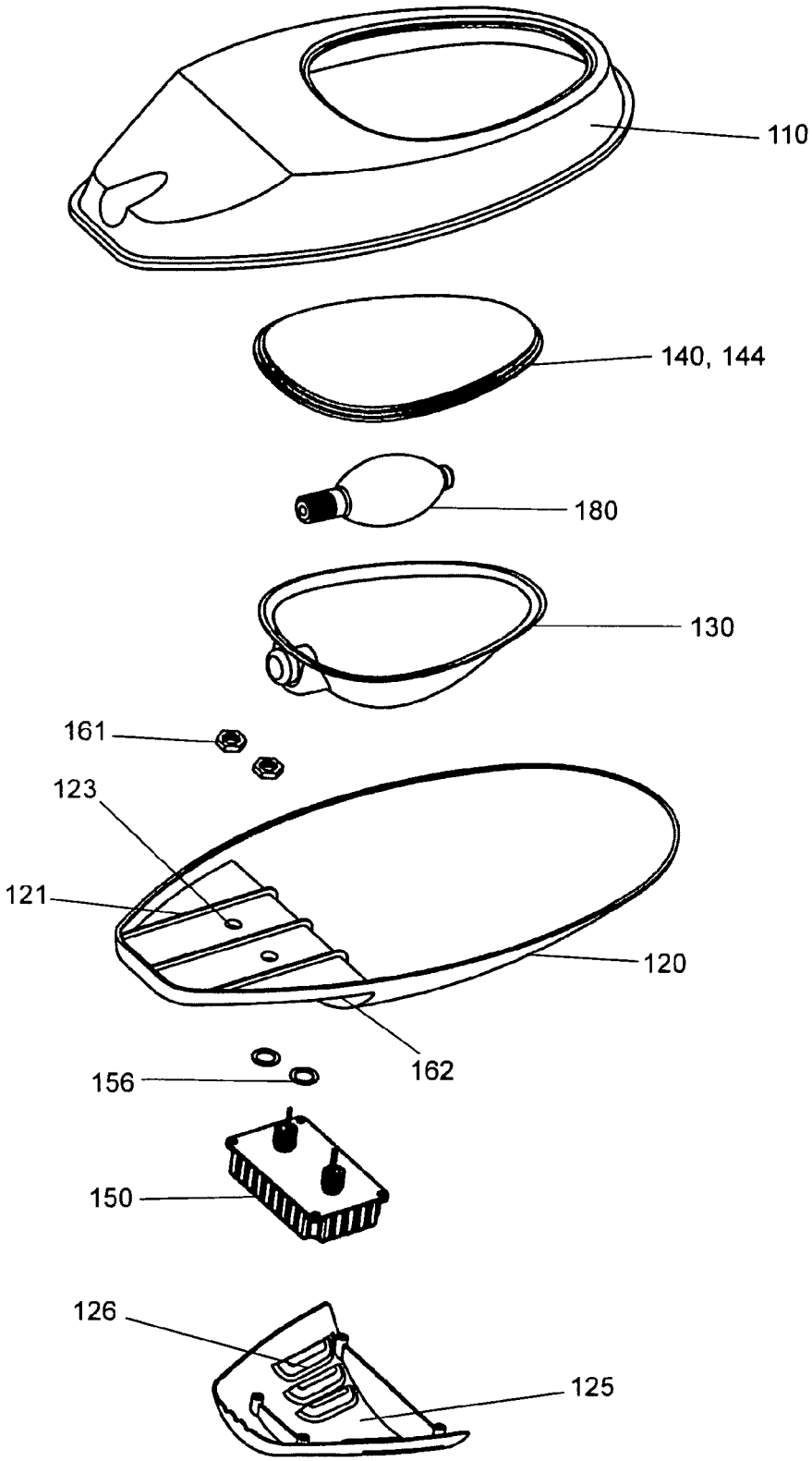
FIG. 7 is a bottom exploded view of the present invention.

FIG. 7 shows an exploded view of the present invention in upside down configuration to show the parts upside down. When reversed, the threaded portion of the ballast 150 can be seen. The threaded portion is the ballast conduit 159. The ballast conduit 159 is locked in place with securing members 161 preferably formed as nuts. The wire aperture seats 123 have openings for passage of ballast water to the socket of the reflector assembly 130. The reflector assembly 130 has a reflector portion and a socket which receives the bulb 180.

Figure 8:
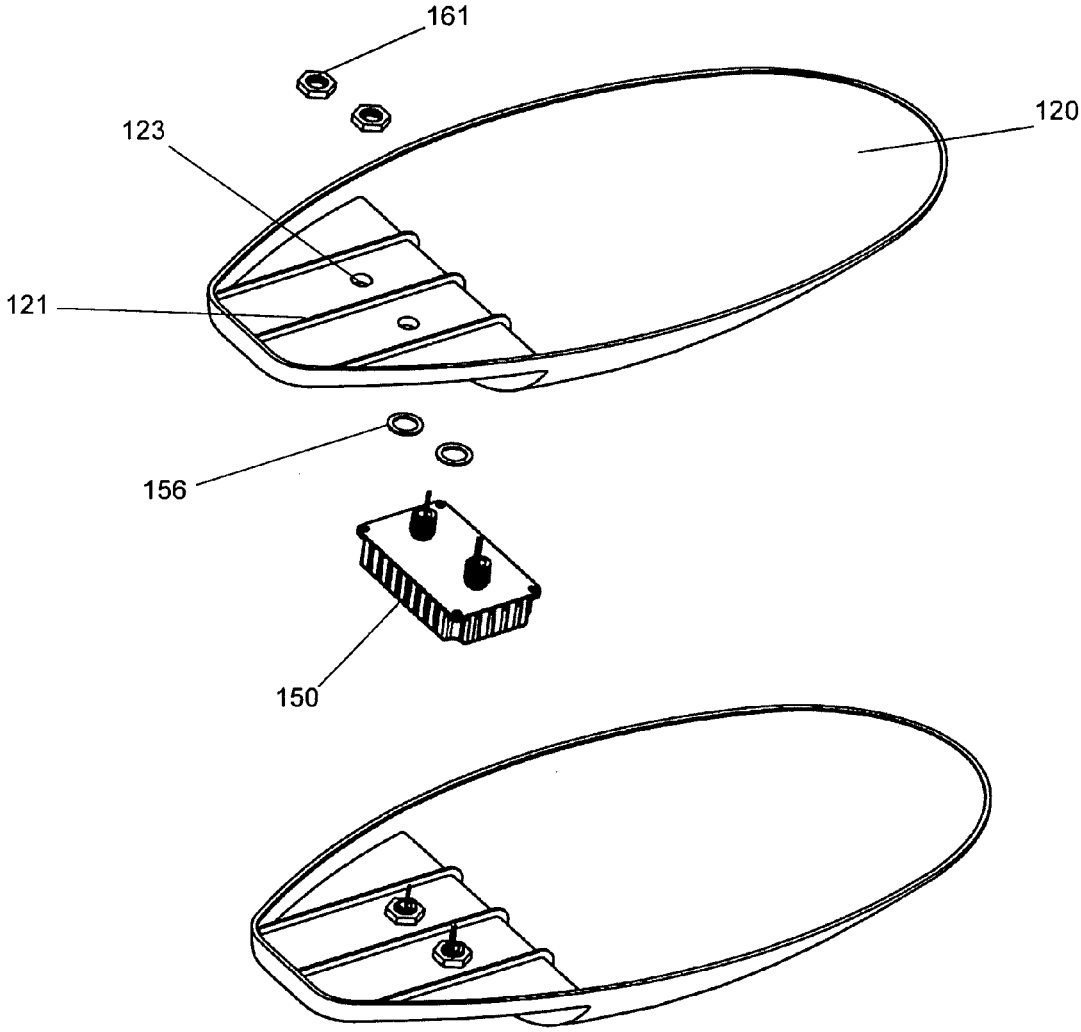
FIG. 8 is a bottom exploded view of the housing.

FIG. 8 shows assembly of the ballast on to the top cover 120. The top cover 120 preferably has reinforcement ribs 121 on a lower surface opposing the ballast mounting surface 162. The securing members 161 and ballast 150 sandwich the seal rings 156 and the wire aperture seats 123.

Figure 9:
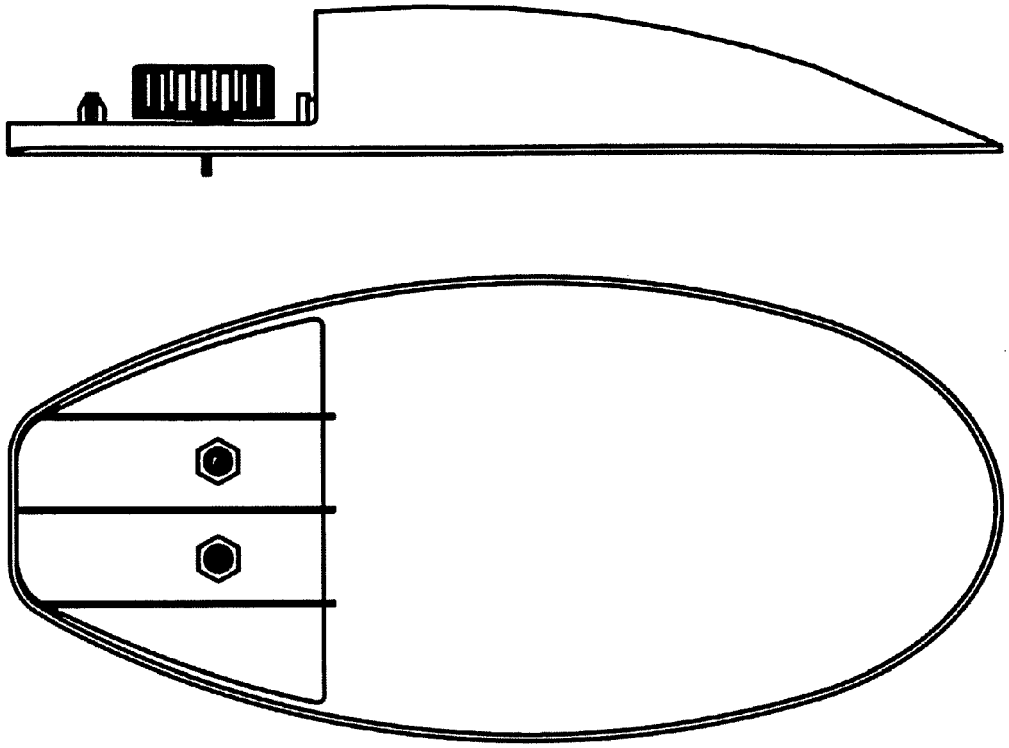
FIG. 9 is a cross section view of the present invention.
Figure 9:
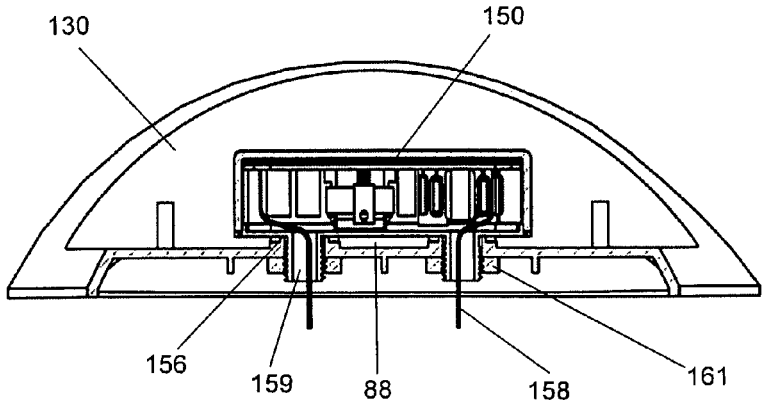

FIG. 9 shows a cross-section of the present invention with the side view of the top cover having the ballast installed, and the bottom view of the top cover having the ballast installed. The cross-section view shows the ballast 150 inside the ballast compartment, and the securing members 161 maintaining a snug fit against the top cover 120. The wire aperture seats 123 formed as annular protrusions 123 have a step was a higher portion and a lower portion. The lower portion receives the seal, and the higher portion abuts the ballast 150 when the securing members 161 are fully tightened. Thus, the dimension of the lower step, namely the height differential between the lower step and the higher step provides a uniform tightness to the seal rings 156 which are sandwiched between the wire aperture seats 123 and the ballast housing 150. Because the wire aperture seats 123 are preferably formed as annular protrusions 123, the ballast 150 is raised above the ballast mounting surface 162 to form a gap 88 of air. The gap 88 is a space between the ballast mounting surface 162 and the ballast 150. The gap 88 has a height above the ballast mounting service 162 equal to the height of the annular protrusions 123. Wire for powering the ballast, namely the ballast wire 158 past through the ballast conduit 159 which is preferably threaded for receiving the securing members 161 when the securing members are nuts.

Figure 10:
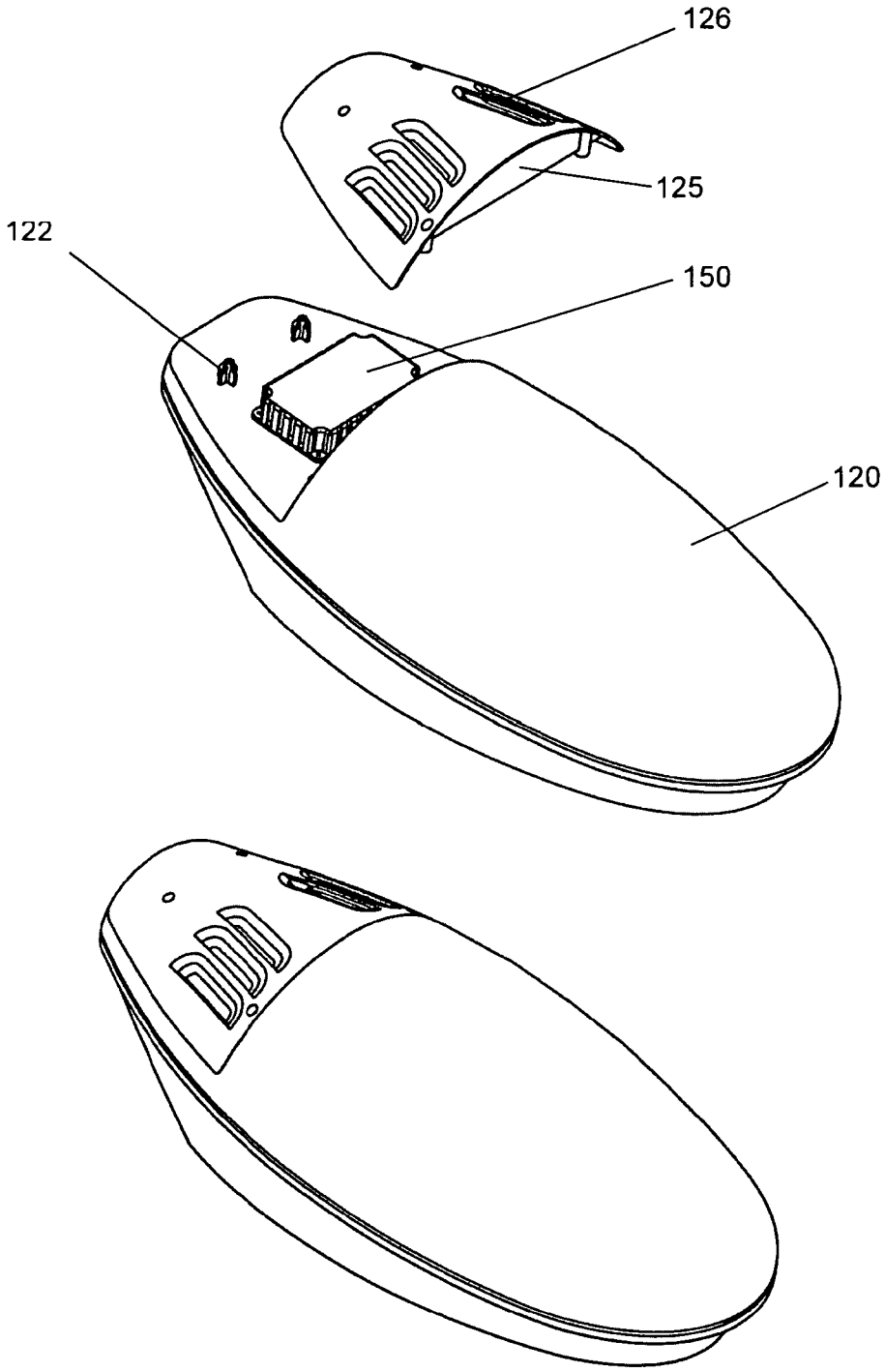
FIG. 10 is an perspective view of the present invention, showing removal of the ballast compartment cover.

FIG. 10 shows end-of-life replacement of the ballast. When the ballast is burned out, the ballast compartment cover 125 is removed from the top cover 120 by unscrewing screws that connect the ballast compartment cover 125 to the top cover 120 at mounting posts 122. The top cover can then be replaced for disassembly of the securing members 161 to provide replacement of the ballast 150.

Therefore, while the presently preferred form has been shown and described, it is to be understood that the present invention is not limited to the sole embodiment described above, but encompasses any and all embodiments within the scope of the following claims. For example, the mounting posts 122 are optional, and can be omitted or substituted by using longer screws or by other geometric modification to the shape of the top cover.

The invention claimed is:

1. A weather resistant road light comprising:

a. a top cover;

b. a ballast mounting surface disposed on a top surface of the top cover, wherein the ballast mounting surface defines a ballast compartment lower surface;

c. at least one wire aperture seat disposed on the ballast mounting surface;

d. a ballast mounted to the at least one wire aperture seat, wherein wires from the ballast pass through the wire aperture seat;

e. a ballast compartment cover covering the ballast compartment, wherein the ballast compartment cover fits over the top of the ballast mounting surface disposed on the top cover;

f. at least one securing member securing the ballast to the ballast mounting surface;

g. a bottom tray mating with the top cover, wherein the bottom tray has a lens opening;

h. a reflector assembly having a socket for receiving bulb, wherein the reflector assembly is mounted on the bottom tray;

i. a lens fitting over the lens opening of the bottom tray, wherein the at least one wire aperture seat is formed as an annular protrusion protruding above the surface of the ballast mounting surface, wherein the ballast secures to the annular protrusion, forming an air gap between a bottom surface of the ballast and the ballast mounting surface, further comprising a step on the at least one wire aperture seat having a higher level and a lower level, further comprising a seal ring mounted on the lower level of the at least one wire aperture seat, wherein the at least one wire aperture seat comprises a pair of wire aperture seats, wherein the ballast further comprises a ballast conduit which passes through the at least one wire aperture seat, wherein the ballast conduit is threaded on a ballast conduit external surface, wherein the at least one securing member is a nut which secures the ballast conduit to the at least one wire aperture seat.

2. The weather resistant road light of claim 1, further comprising reinforcement ribs on a lower surface of the top cover, wherein the ballast compartment cover further comprises reinforcement ribs, wherein a post receiver is located at a level higher than the lens.

3. A weather resistant road light comprising:

a. a top cover;

b. a ballast mounting surface disposed on a top surface of the top cover, wherein the ballast mounting surface defines a ballast compartment lower surface;

c. at least one wire aperture seat disposed on the ballast mounting surface;

d. a ballast mounted to the at least one wire aperture seat, wherein wires from the ballast pass through the wire aperture seat;

e. a ballast compartment cover covering the ballast compartment, wherein the ballast compartment cover fits over the top of the ballast mounting surface disposed on the top cover;

f. at least one securing member securing the ballast to the ballast mounting surface;

g. a bottom tray mating with the top cover, wherein the bottom tray has a lens opening;

h. a reflector assembly having a socket for receiving bulb, wherein the reflector assembly is mounted on the bottom tray;

i. a lens fitting over the lens opening of the bottom tray, further comprising a step on the at least one wire aperture seat having a higher level and a lower level, further comprising a seal ring mounted on the lower level of the at least one wire aperture seat, wherein the at least one wire aperture seat comprises a pair of wire aperture seats, wherein the ballast further comprises a ballast conduit which passes through the at least one wire aperture seat, wherein the ballast conduit is threaded on a ballast conduit external surface, wherein the at least one securing member is a nut which secures the ballast conduit to the at least one wire aperture seat.

4. The weather resistant road light of claim 3, further comprising reinforcement ribs on a lower surface of the top cover, wherein the ballast compartment cover further comprises reinforcement ribs, wherein a post receiver is located at a level higher than the lens.

5. A weather resistant road light comprising:

a. a top cover;

b. a ballast mounting surface disposed on a top surface of the top cover, wherein the ballast mounting surface defines a ballast compartment lower surface;

c. at least one wire aperture seat disposed on the ballast mounting surface;

d. a ballast mounted to the at least one wire aperture seat, wherein wires from the ballast pass through the wire aperture seat;

e. a ballast compartment cover covering the ballast compartment, wherein the ballast compartment cover fits over the top of the ballast mounting surface disposed on the top cover;

f. at least one securing member securing the ballast to the ballast mounting surface;

g. a bottom tray mating with the top cover, wherein the bottom tray has a lens opening;

h. a reflector assembly having a socket for receiving bulb, wherein the reflector assembly is mounted on the bottom tray;

i. a lens fitting over the lens opening of the bottom tray, wherein the at least one wire aperture seat comprises a pair of wire aperture seats, wherein the ballast further comprises a ballast conduit which passes through the at least one wire aperture seat, wherein the ballast conduit is threaded on a ballast conduit external surface, wherein the at least one securing member is a nut which secures the ballast conduit to the at least one wire aperture seat.

6. The weather resistant road light of claim 5, further comprising reinforcement ribs on a lower surface of the top cover, wherein the ballast compartment cover further comprises reinforcement ribs, wherein a post receiver is located at a level higher than the lens.

7. A weather resistant road light comprising:

a. a top cover;

b. a ballast mounting surface disposed on a top surface of the top cover, wherein the ballast mounting surface defines a ballast compartment lower surface;

c. at least one wire aperture seat disposed on the ballast mounting surface;

d. a ballast mounted to the at least one wire aperture seat, wherein wires from the ballast pass through the wire aperture seat;

e. a ballast compartment cover covering the ballast compartment, wherein the ballast compartment cover fits over the top of the ballast mounting surface disposed on the top cover;

f. at least one securing member securing the ballast to the ballast mounting surface;

g. a bottom tray mating with the top cover, wherein the bottom tray has a lens opening;

h. a reflector assembly having a socket for receiving bulb, wherein the reflector assembly is mounted on the bottom tray;

i. a lens fitting over the lens opening of the bottom tray, wherein the ballast further comprises a ballast conduit which passes through the at least one wire aperture seat, wherein the ballast conduit is threaded on a ballast conduit external surface, wherein the at least one securing member is a nut which secures the ballast conduit to the at least one wire aperture seat.

8. The weather resistant road light of claim 7, further comprising reinforcement ribs on a lower surface of the top cover, wherein the ballast compartment cover further comprises reinforcement ribs, wherein a post receiver is located at a level higher than the lens.

* * * * *